US008369742B2

(12) United States Patent
Koshimori

(10) Patent No.: US 8,369,742 B2
(45) Date of Patent: Feb. 5, 2013

(54) IMAGE FORMING AGENT STORAGE CONTAINER, IMAGE FORMING APPARATUS, METHOD OF MOUNTING IMAGE FORMING AGENT STORAGE CONTAINER, AND METHOD OF REMOVING IMAGE FORMING AGENT STORAGE CONTAINER

(75) Inventor: Kazunori Koshimori, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 407 days.

(21) Appl. No.: 12/721,281

(22) Filed: Mar. 10, 2010

(65) Prior Publication Data

US 2010/0232829 A1 Sep. 16, 2010

(30) Foreign Application Priority Data

Mar. 11, 2009 (JP) ..... 2009-057987

(51) Int. Cl.
*G03G 15/00* (2006.01)

(52) U.S. Cl. ..... 399/110; 399/262

(58) Field of Classification Search ..... 399/110, 399/112, 119, 120, 258, 262
See application file for complete search history.

(56) References Cited

U.S. PATENT DOCUMENTS

2008/0175629 A1* 7/2008 Eto et al. ..... 399/262

FOREIGN PATENT DOCUMENTS

| | | | |
|---|---|---|---|
| EP | 1950624 | A1 | 7/2008 |
| JP | 2007-093697 | A | 4/2007 |
| JP | 2007-178971 | A | 7/2007 |
| JP | 2007-322992 | A | 12/2007 |
| WO | 2006093361 | A1 | 9/2006 |

OTHER PUBLICATIONS

Extended European Search report issued on Mar. 2, 2012 by the European Patent Office in the counterpart European Patent Application No. 10153494.9.
Notice of Reasons for Refusal in counterpart Japanese Application No. 2009-057987, dated May 11, 2009.
U.S. Appl. No. 12/721,294 by Masaya Okamoto, filed Mar. 10, 2010.
U.S. Appl. No. 12/721,277 by Masaya Okamoto, filed Mar. 10, 2010.

* cited by examiner

*Primary Examiner* — Walter L Lindsay, Jr.
*Assistant Examiner* — Barnabas Fekete
(74) *Attorney, Agent, or Firm* — Sughrue Mion, PLLC

(57) ABSTRACT

An image forming agent storage container includes a container body, a driven transmission member, and a guide part. The container body stores an image forming agent. The container body is configured to be mounted to an image forming apparatus body. The driven transmission member is provided along a side face of the container body. A driving force is transmitted to the driven transmission member. The guide part guides mounting of the container body to the image forming apparatus body. The guide part is located in a position anterior to the driven transmission member in a mounting direction in which the container body is mounted to the image forming apparatus body. The guide part is provided so as to project in a direction away from the side face of the container body.

15 Claims, 14 Drawing Sheets

IMAGE FORMING AGENT STORAGE CONTAINER, IMAGE FORMING APPARATUS, METHOD OF MOUNTING IMAGE FORMING AGENT STORAGE CONTAINER, AND METHOD OF REMOVING IMAGE FORMING AGENT STORAGE CONTAINER

CROSS-REFERENCE TO RELATED APPLICATIONS

This application is based on and claims priority under 35 USC 119 from Japanese Patent Application No. 2009-57987 filed Mar. 11, 2009.

BACKGROUND

Technical Field

The present invention relates to an image forming agent storage container, an image forming apparatus, a method of mounting the image forming agent storage container, and a method of removing the image forming agent storage container.

SUMMARY

According to an aspect of the invention, an image forming agent storage container includes a container body, a driven transmission member, and a guide part. The container body stores an image forming agent. The container body is configured to be mounted to an image forming apparatus body. The driven transmission member is provided along a side face of the container body. A driving force is transmitted to the driven transmission member. The guide part guides mounting of the container body to the image forming apparatus body. The guide part is located in a position anterior to the driven transmission member in a mounting direction in which the container body is mounted to the image forming apparatus body. The guide part is provided so as to project in a direction away from the side face of the container body.

BRIEF DESCRIPTION OF THE DRAWINGS

Exemplary embodiments of the invention will be described in detail based on the accompanying drawings, wherein:

FIG. 8A is a side view showing a state where the operating member is in a first position, FIG. 8B is a side view showing a state where the operating member is in a second position, and FIG. 8C is a side view showing a state where the operating member is in a third position;

FIG. 9A is a section view showing a state where the operating member is in the first position, FIG. 9B is a section view showing a state where the operating member is in the second position, and FIG. 9C is a section view showing a state where the operating member is in the third position;

FIG. 12A is a right side view showing the storage container in a state where the operating member is arranged in the second position, and FIG. 12B is a view showing the right side face of the storage container, and a cross-section of the mounting device;

DETAILED DESCRIPTION

Hereinafter, exemplary embodiments of the invention will be described with reference to the accompanying drawings.

Figure 1:
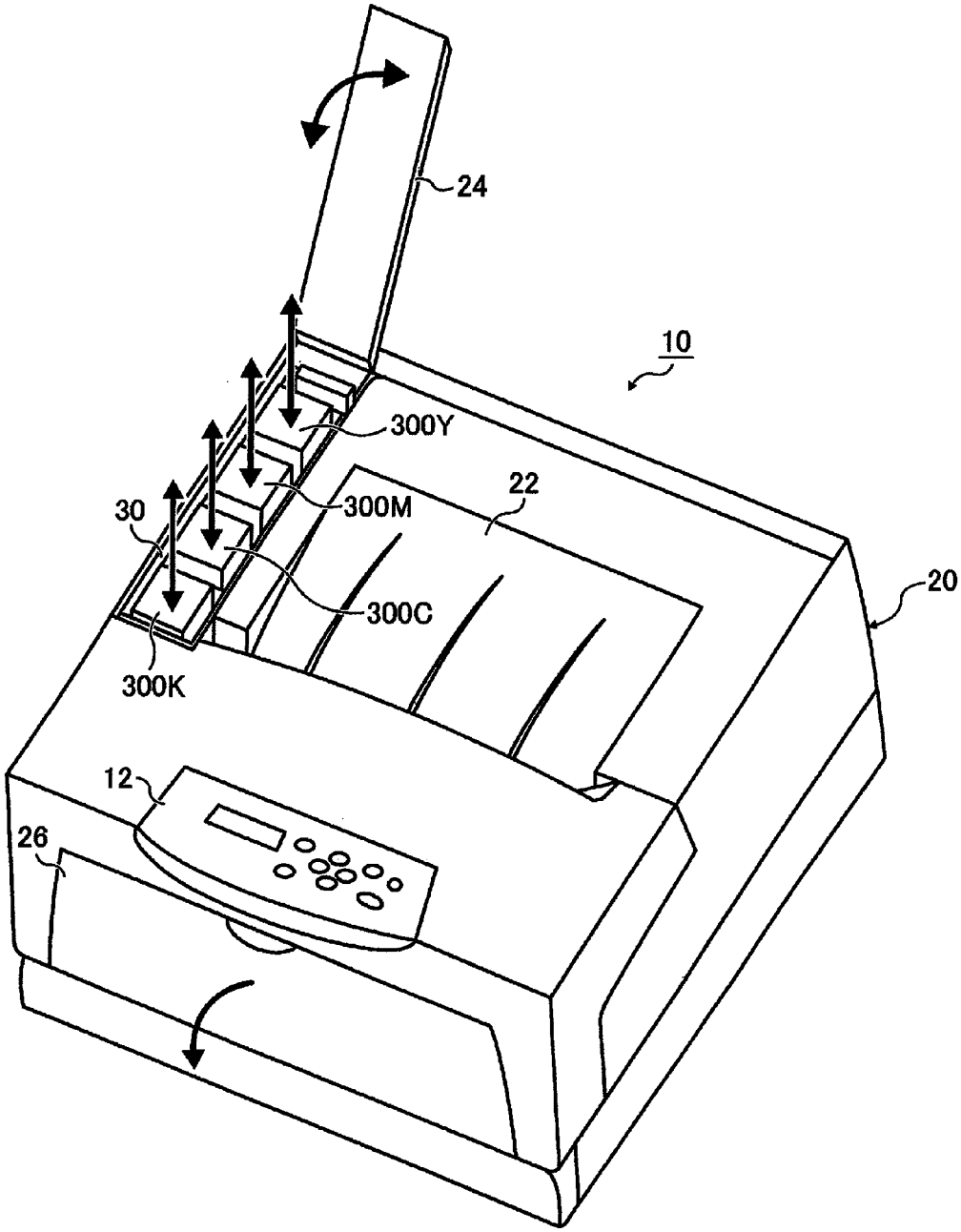
FIG. 1 is a perspective view showing an image forming apparatus according to an exemplary embodiment of the invention.

FIG. 1 shows an image forming apparatus 10 according to the exemplary embodiment of the invention. As shown in FIG. 1, the image forming apparatus 10 has an image forming apparatus body 20, and an upper part of the image forming apparatus body 20 is used as a discharge part 22 from which a paper on which an image has been formed is discharged. Also, an operation panel 12 used as an operation device is mounted to a front side of the image forming apparatus body 20.

A mounting opening and closing part 24, and a paper-feed opening and closing part 26 are mounted to the image forming apparatus body 20 so that each of them can be opened and closed. The mounting opening and closing part 24 is opened when storage containers 300Y, 300M, 300C, and 300K used image forming agent storage containers are mounted to the image forming apparatus body 20, and is opened when the storage containers 300Y, 300M, 300C, and 300K are detached from an inside of the image forming apparatus body 20. The mounting opening and closing part 24 is closed when image formation is performed. The paper-feed opening and closing part 26 is opened when papers on which images are to be formed are supplied from the front side of the image forming apparatus body 20. Also, the mounting opening and closing part 24 is opened and closed in a manner of rotating the mounting opening and closing 24 with the rear of the image forming apparatus body 20 in FIG. 1 used as a fulcrum (in such a manner that a fulcrum is formed on a short side of the mounting opening and closing part 24). However, this is not limited to the configuration of FIG. 1. The mounting opening and closing part 24 may be opened and closed in a manner of rotating the mounting opening and closing part 24 with a side of the image forming apparatus body 20 used as a fulcrum (in such a manner that a fulcrum is formed on a long side of the mounting opening and closing part 24). Also, a mounting device 30 on which the storage containers 300Y, 300M, 300C, and 300K are to be mounted is provided in the image forming apparatus body 20.

Yellow toner, magenta toner, cyan toner, and black toner used as image forming agents are respectively stored in the storage containers 300Y, 300M, 300C, and 300K. The storage containers 300Y, 300M, and 300C have the same shape and size, and are configured to be able to store the same capacity of toner. The storage container 300K is configured so as to be vertically longer than the storage containers 300Y, 300M, and 300C, and has a larger volume than the storage containers 300Y, 300M, and 300C, with a larger capacity that stores more toner than the storage containers 300Y, 300M, and 300C.

The storage containers 300Y, 300M, and 300C have different toner capacity from the storage container 300K, but have the same members and functions. Hereinafter, except for the case where a specific storage container is shown, the storage containers 300Y, 300M, 300C, and 300K will be collectively referred to as the storage container 300.

Figure 2:
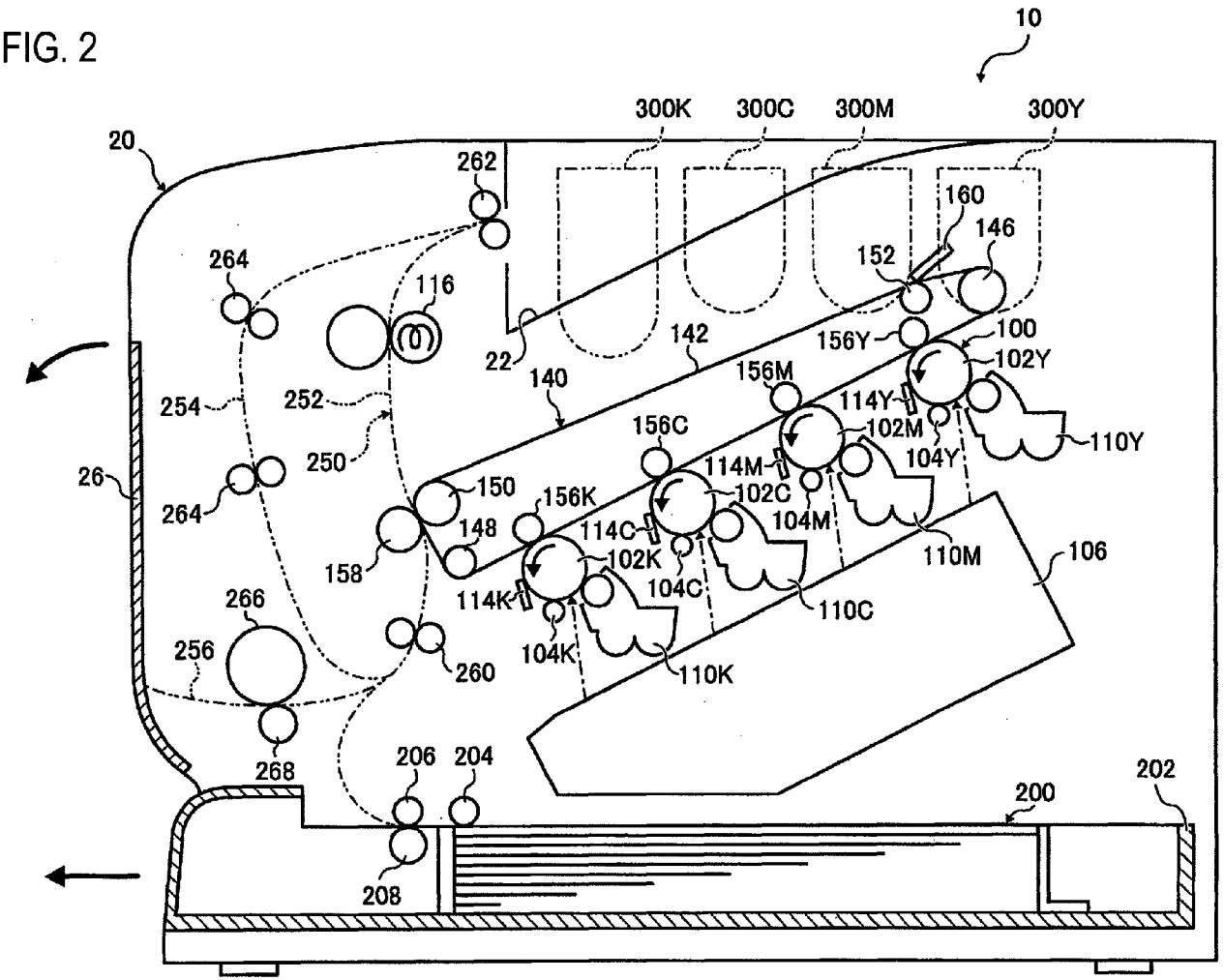
FIG. 2 is a side perspective view showing the image forming apparatus according to the exemplary embodiment of the invention.

FIG. 2 is a section of the image forming apparatus 10.

As shown in FIG. 2, an image forming part 100 and a paper feeder 200 which supplies papers to the image forming part 100 are mounted to the image forming apparatus body 20. Also, a conveyance path 250 used for conveyance of papers is formed in the image forming apparatus body 20.

The image forming part 100 has photosensitive drums 102Y, 102M, 102C, and 102K used as image carriers, charging devices 104Y, 104M, 104C, and 104K which respectively charge the photosensitive drums 102Y, 102M, 102C, and 102K, a latent image forming device 106 which emit light onto the photosensitive drums 102Y, 102M, 102C, and 102K charged by the charging devices 104Y, 104M, 104C, and 104K to form electrostatic latent images, and developing devices 110Y, 110M, 110C, and 110K which develop electrostatic latent images, which have been formed on the surfaces of the photosensitive drums 102Y, 102M, 102C, and 102K by the latent image forming device 106, using toner to form a yellow toner image, a magenta toner image, a cyan toner image, and a black toner image.

Yellow toner, magenta toner, cyan toner, and black toner are supplied to the developing devices 110Y, 110M, 110C, and 110K, respectively from the storage containers 300Y, 300M, 300C, and 300K.

Also, the image forming part 100 has a transfer device 140 which transfers to a paper the yellow toner image, the magenta toner image, the cyan toner image, and the black toner image, which have respectively been formed by the developing devices 110Y, 110M, 110C, and 110K. The image forming part 100 also has cleaning devices 114Y, 114M, 114C, and 114K which clean the surfaces of the photosensitive drums 102Y, 102M, 102C, and 102K, and a fixing device 116 which fixes the toner images transferred by the transfer device 140 to the paper.

The transfer device 140 has a belt-like intermediate transfer body 142 to which the yellow toner image, the magenta toner image, the cyan toner image, and the black toner image, which have been formed on the photosensitive drums 102Y, 102M, 102C, and 102K, are transferred so as to overlap each other, and which is used as a transfer medium. The intermediate transfer body 142 is supported by supporting rollers 146, 148, 150, and 152 so as to be rotatable.

Also, the transfer device 140 has primary transfer rollers 156Y, 156M, 156C, and 156K used as primary transfer devices which transfer to the intermediate transfer body the yellow toner image, the magenta toner image, the cyan toner image, and the black toner image, which have respectively been formed on the photosensitive drums 102Y, 102M, 102C, and 102K, and a secondary transfer roller 158 used as a secondary transfer device which transfers to a paper the yellow toner image, the magenta toner image, the cyan toner image, and the black toner image, which have been transferred to the intermediate transfer body 142. Also, the transfer device 140 has a cleaning device 160 which cleans the surface of the intermediate transfer body 142.

The paper feeder 200 has, for example, a paper housing part 202 which uses a cassette, an extraction roller 204 for extracting paper which is located at the uppermost position and which is housed in the paper housing part 202, a conveying roller 206 which conveys the paper extracted by the extraction roller 204 toward the image forming part 100, and a separating roller 208 which comes into contact with the conveying roller 206 and separates papers between the separating roller and the conveying roller 206. The paper housing part 202 is configured to be able to be pulled out, for example, to the front side (the left side in FIG. 2) of the image forming apparatus body 20, and papers are replenished into the paper housing part 202 in a state where the paper housing part has been pulled out from the image forming apparatus body 20.

The conveyance path 250 has a main conveyance path 252, a reverse conveyance path 254, and an auxiliary conveyance path 256.

The main conveyance path 252 is a conveyance path which conveys a paper supplied from the paper feeder 200 toward the discharge part 22, and is mounted with a registration roller 260, the secondary transfer roller 158, the fixing device 116, and a discharge roller 262 in order from the upstream side in a paper conveying direction, along the main conveyance path 252. The registration roller 260 starts its rotation at a predetermined timing from a stopped state, and supplies a paper to a contact portion between the intermediate transfer body 142 and the secondary transfer roller 158 so as to match the timing at which a toner image is transferred to the intermediate transfer body 142.

A discharge roller 262 discharges the paper on which the toner image is fixed by the fixing device 116 to the discharge part 22. Also, when images are to be formed on both faces of a paper, the discharge roller 262 rotates in a direction opposite to a direction for the case where a paper is discharged to the discharge part 22, and supplies the paper on which an image is formed on one surface thereof to the reverse conveyance path 254 from its rear end side.

The reverse conveyance path 254 is used when the paper one surface of which an image is formed on is again supplied to the upstream of the registration roller 260 while the paper is inverted. Two reverse conveying rollers 264 and 264 are mounted along the reverse conveyance path 254.

The auxiliary conveyance path 256 is a conveyance path used when a paper is supplied from the front side of the image forming apparatus body 20 in a state where the paper-feed opening and closing part 26 is opened with respect to the image forming apparatus body 20. An auxiliary conveying roller 266 which conveys a paper toward the registration roller 260, and a separating roller 268 which is used to contact with the auxiliary conveying roller 266 so as to separate the papers, are mounted along the auxiliary conveyance path 256.

FIGS. 3 to 7 show the storage container 300.

As described above, the respective storage containers 300Y, 300M, and 300C have the same shape and size, and the storage container 300K has a larger capacity than the storage containers 300Y, 300M, and 300C. FIGS. 3 to 6 show the storage container 300 used as the storage containers 300Y, 300M, and 300C.

As shown in FIGS. 3 to 7, the storage container 300 has a container body 310, an opening and closing part 350, an operating member 380 used as an operating part, and a gear 370 used as a driven transmission member. The storage container 300 is formed with a discharge hole 312 in a position which is a lower side relative to the direction of gravity in a state where the storage container 300 is mounted to the image forming apparatus body 20 (see FIG. 1). The toner discharged from the discharge hole 312 is supplied to the developing device 110 and is used for image formation.

Also, the container body 310 is formed with a filling hole 314, which is used to fill toner into the container body 310, in a position which is in an upward direction relative to the direction of gravity in the state where the storage container 300 is mounted to the image forming apparatus body 20. The filling hole 314 is formed over substantially the whole region in the upward face of the container body 310, and toner is filled into the container body 310 via the filling hole 314 in such a manner that the toner is dropped from above in the direction of gravity. The shape of the filling hole 314 when viewed from above in the direction of gravity is substantially a rectangular shape. Therefore, the shape of the upward face of the container body 310 when viewed from above in the direction of gravity is also substantially a rectangular shape.

Also, a fixing projection 316 is formed on a front face of the container body 310 so as to project toward the front side. The fixing projection 316 is used as a fixing member which fixes the operating member 380 to a third position which will be described later.

Figure 5:
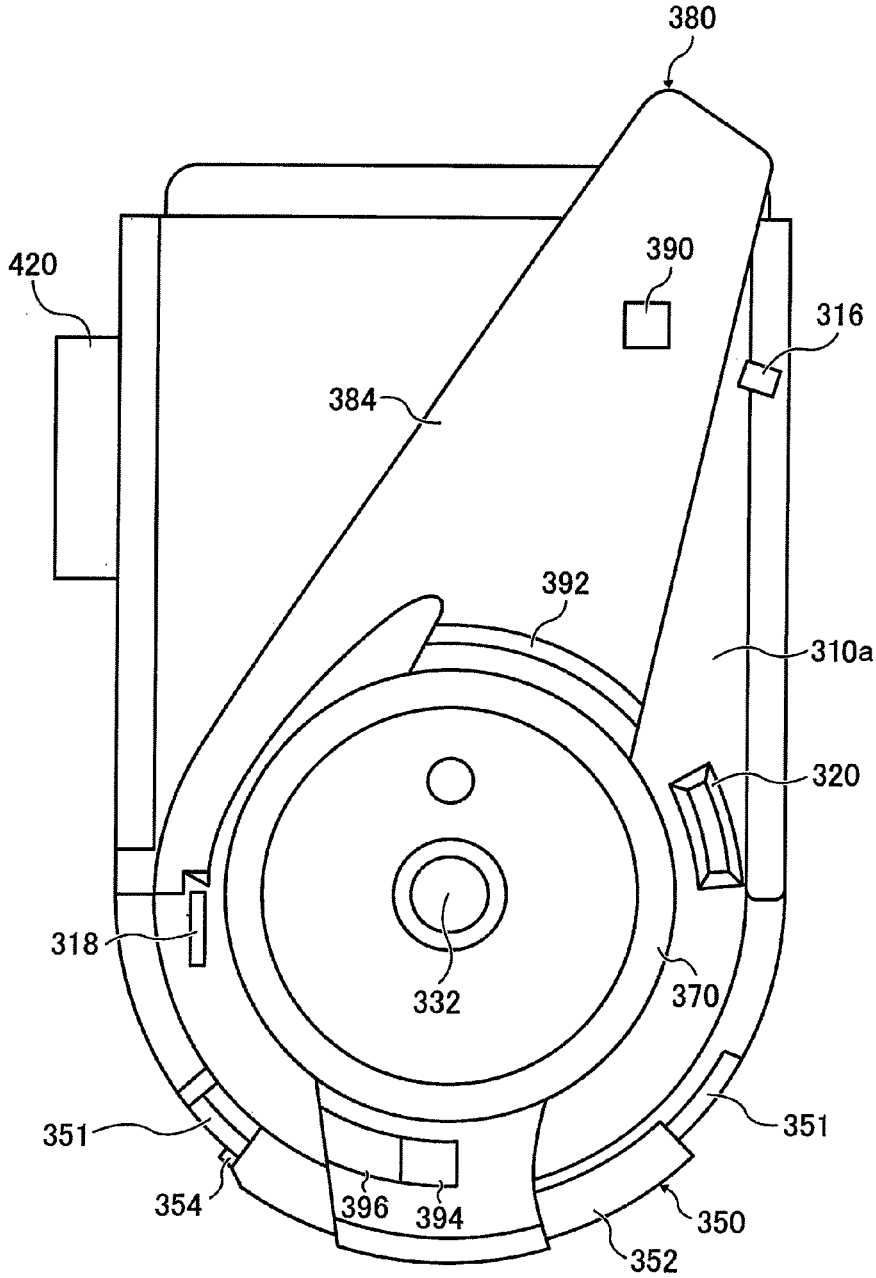
FIG. 5 is a side view showing the storage container according to the exemplary embodiment of the invention.

Also, a prohibiting projection 318 is formed on a front-side side face of the container body 310 so as to project toward the front side (see FIG. 5). The prohibiting projection 318 is used as a movement prohibiting member which prohibits the operating member 380 from moving from a second position which will be described later to a first position which will be described later. Also, the prohibiting projection 318 is used as an opening prohibiting member which prohibits the discharge hole 312 from being opened in a state where the container body 310 is not mounted to the image forming apparatus body 20.

Also, a protecting projection 320 is formed in a position on the front side of the container body 310 and near the gear 370, so as to project toward the front side. The protecting projection 320 makes it difficult for a face of the gear 370 on which teeth are formed to collide with other objects, thereby protecting the gear 370.

A stirring device 330 used as a stirring part for stirring the toner stored in the container body 310 is mounted to the inside of the container body 310. The stirring device 330 has the shaft 322 attached to the container body 310 so as to be rotatable about a rotary axis 332, a parallel part 334 which is attached to the shaft 322 and is substantially parallel to the shaft 322, and a stirring plate 336 which is attached to the shaft 322. The stirring plate 336 is made of an elastic film-like sheet, and is configured so that its distal end comes into contact with an internal face of the container body 310.

Also, a cylindrical-shaped supporting projection 324, which is used to rotatably support the operating member 380, is formed on a rear face of the container body 310. Also, a supporting projection (not shown), which is used to rotatably support the operating member 380, is formed on the front face of the container body 310 similarly to the supporting projection 324.

Figure 7:
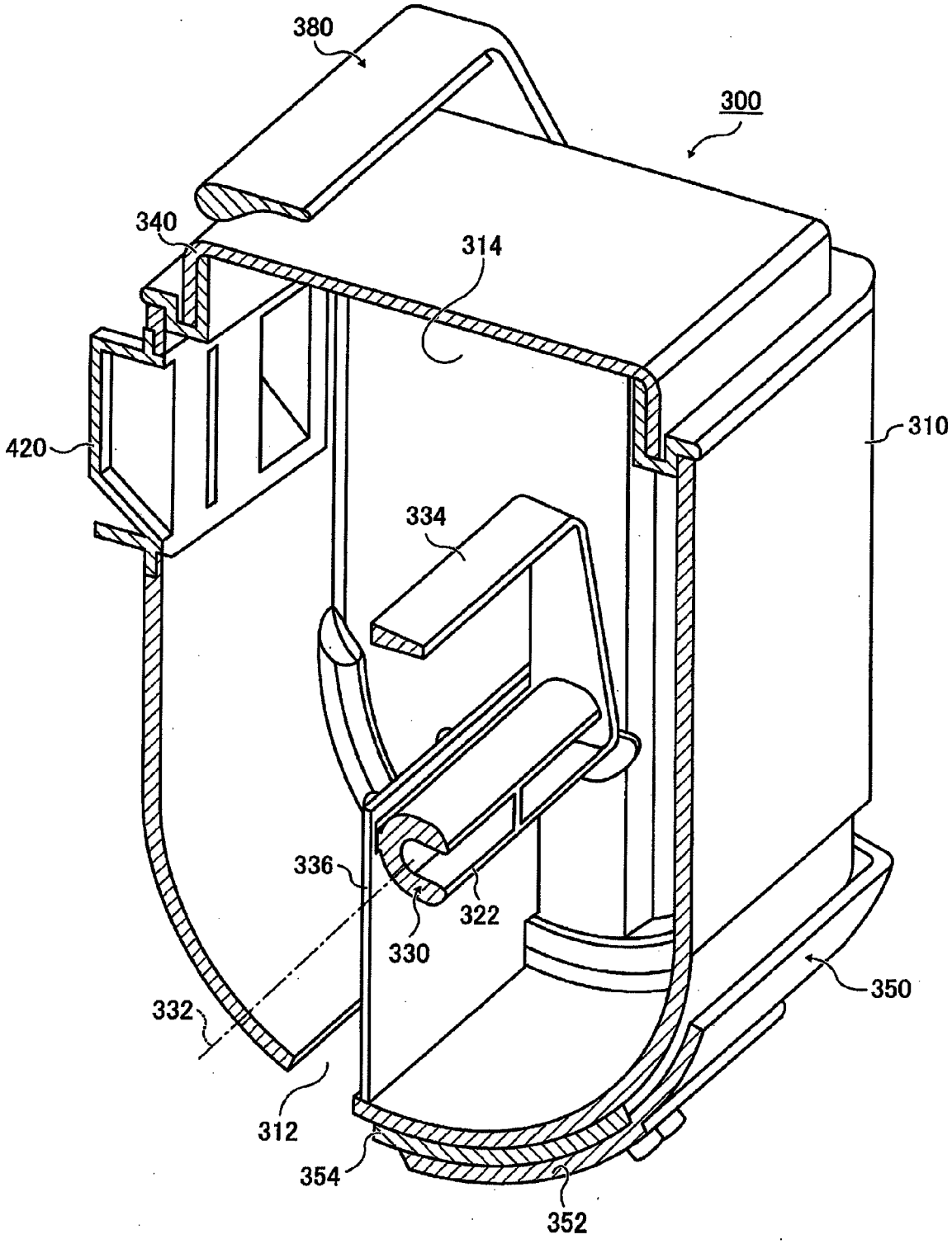
FIG. 7 is a side view showing a section of the storage container according to the exemplary embodiment of the invention.

Also, as shown in FIG. 7, the stirring device 330 may be arranged so that its longitudinal direction is coincide with a vertical direction that is a direction in which toner is filled into the container body 310 via the filling hole 314. If the toner is filled into the container body 310 in a state where the stirring device 330 is arranged in such a position, the downward movement of the toner from above is hardly hindered by the stirring device 330, and the toner can be effectively stored in the container body 310 elongating in the vertical direction.

Also, the left face of the container body 310 is mounted with an identification member 420 which is used as an identification part. The identification member 420 has plural (for example, three) convex portions 422, and concave portions 424 are formed between the convex portions 422 which are adjacent to each other. The concave portions 424 are formed so that at least any one of the number, position, and width thereof differ according to a type of toner stored in the container body 310. At least any one of the number, position, and width of the concave portions 424 differ according to, for example, whether a color of toner stored in the container body 310 is yellow, magenta, or cyan. Also, even when, for example, black toner that is the same color is stored, if any of toners used for different types of models is stored, or if any of toners having different characteristics is stored, at least one of the number, position, and width of the concave portions 424 differs according to the model and the characteristic.

Also, printing or the like, which allows an operator or the like to identify the type of a toner to be filled or toner already filled, is formed on the identification member 420. This printing or the like is arranged in a position which can be viewed in a state where the operating member 380 is arranged at least at a second position which will be described later. Also, this printing or the like is also arranged on the operating member 380 or the upper face of a lid member 340 which will be described later.

Also, a storage medium 450 used as a storage device is mounted to the rear face of the container body 310 so as to be detachable from the container body 310. The storage medium 450 can be connected with a data writing device (not shown) provided on the image forming apparatus body 20, and data, such as the number of images formed with the toner stored in the storage container 300, from the data writing device is written therein. Connecting terminals 451 of the storage medium 450 extend so as to be long in the vertical direction, and are provided so that their lower portions including the lower ends in the vertical direction are exposed, and four connecting terminals are provided in the right-and-left horizontal direction. As described later in detail, in the state of FIG. 4 where the opening and closing part 350 connected with the operating member 380 closes the discharge hole 312 (a state where the operating member 380 is in the second position), a lower portion (on the opening-and-closing-part-350 side) of a rear arm portion 386 of the operating member 380 retreats from the lower portions of the connecting terminals of the storage medium 450.

The opening and closing part 350 is attached so as to be movable to a lower position of the container body 310. As the opening and closing part 350 moves with respect to the container body 310, the discharge hole 312 is brought into an opened state or is brought into a closed state. The opening and closing part 350 has an opening and closing member 352 which is mounted so as to be movable with respect to the container body 310, and a sealing member 354 which is provided between the opening and closing member 352 and the container body 310 and is used to seal the discharge hole 312.

The operating member 380 has a facing portion 382 which is arranged in a position which faces the filling hole 314, a front arm portion 384 which extends from a front end of the facing portion 382, and the rear arm portion 386 which extends from a rear end of the facing portion 382. A through hole (not shown) is formed in the front arm portion 384 so that the supporting projection (not shown) formed on the front side of the container body 310 fits thereinto. A through hole 408 is formed in the rear arm portion 386 so that the supporting projection 324 formed on the rear face of the container body 310 fits thereinto.

The supporting projection formed in the front face of the container body 310 is inserted into the through hole formed in the front arm portion 384, and the supporting projection 324 is inserted into the through hole 408. Thereby, the operating member 380 is supported so as to be rotatable about the rotary axis 332, and can be moved between a first position, the second position, and the third position, which will be described later.

A through hole 390 is formed in the front arm portion 384. The through hole 390 is formed in a position where the fixing projection 316 fits thereinto in a state where the operating member 380 is arranged in the third position, which will be described later. For this reason, the operating member 380 is fixed by the through hole 390 and the fixing projection 316 to the third position with respect to the container body 310.

Figure 8A:
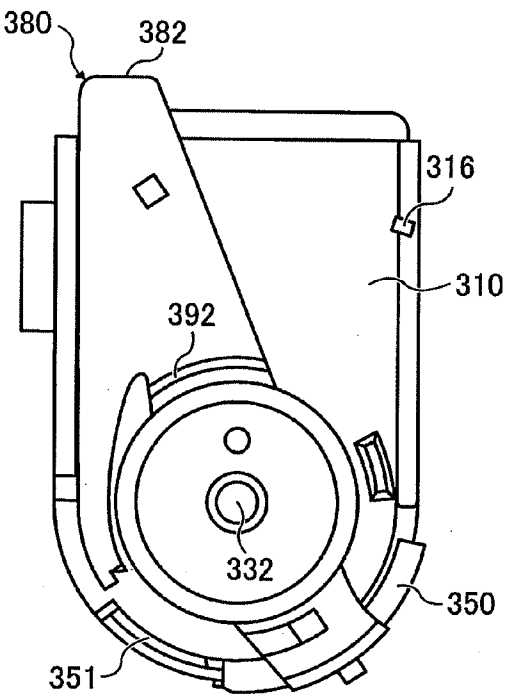
FIGS. 8A to 8C illustrate movement of an operating member of the storage container according to the exemplary embodiment of the invention, and specifically.
Figure 8B:
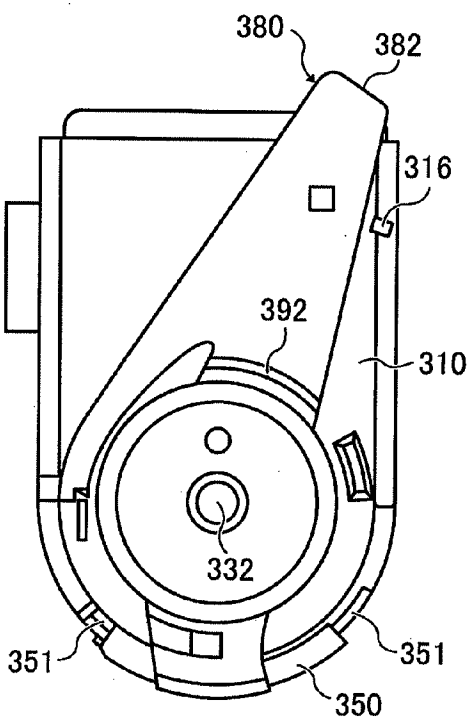

Also, a protecting projection 392 is formed in the front arm portion 384 so as to be located above the gear 370. The protecting projection 392 protects a face of the gear 370 on which teeth are formed, and keeps an operator from touching the gear 370 in a state where the storage container 300 is mounted to the image forming apparatus body 20. That is, the protecting projection 392 is located above the gear 370, and is formed in an arc shape so as to cover the upper portion of the gear 370 including at least an apex in a state as shown in FIG. 8A, i.e., in a state where the storage container 300 is mounted to the image forming apparatus body 20. Also, the protecting projection may be formed in an arc shape so as to cover the upper portion of the gear 370 including at least the apex, even in a state as shown in FIG. 8B, i.e., in a state where the storage container 300 is removed out of the image forming apparatus body 20.

Also, a guiding projection 394 is formed at the lower end of the front arm portion 384 and on a distal end side of the storage container 300 in a direction in which the storage container 300 is inserted into the image forming apparatus body 20. The guiding projection 394 is used as a guide part which guides mounting of the container body 310 into the image forming apparatus body 20, is fitted into a guide groove 46 (see FIG. 11) formed on the image forming apparatus body 20, and guides the mounting of the storage container 300 into the image forming apparatus body 20 and removing of the storage container 300 out of the image forming apparatus body 20.

Figure 3:
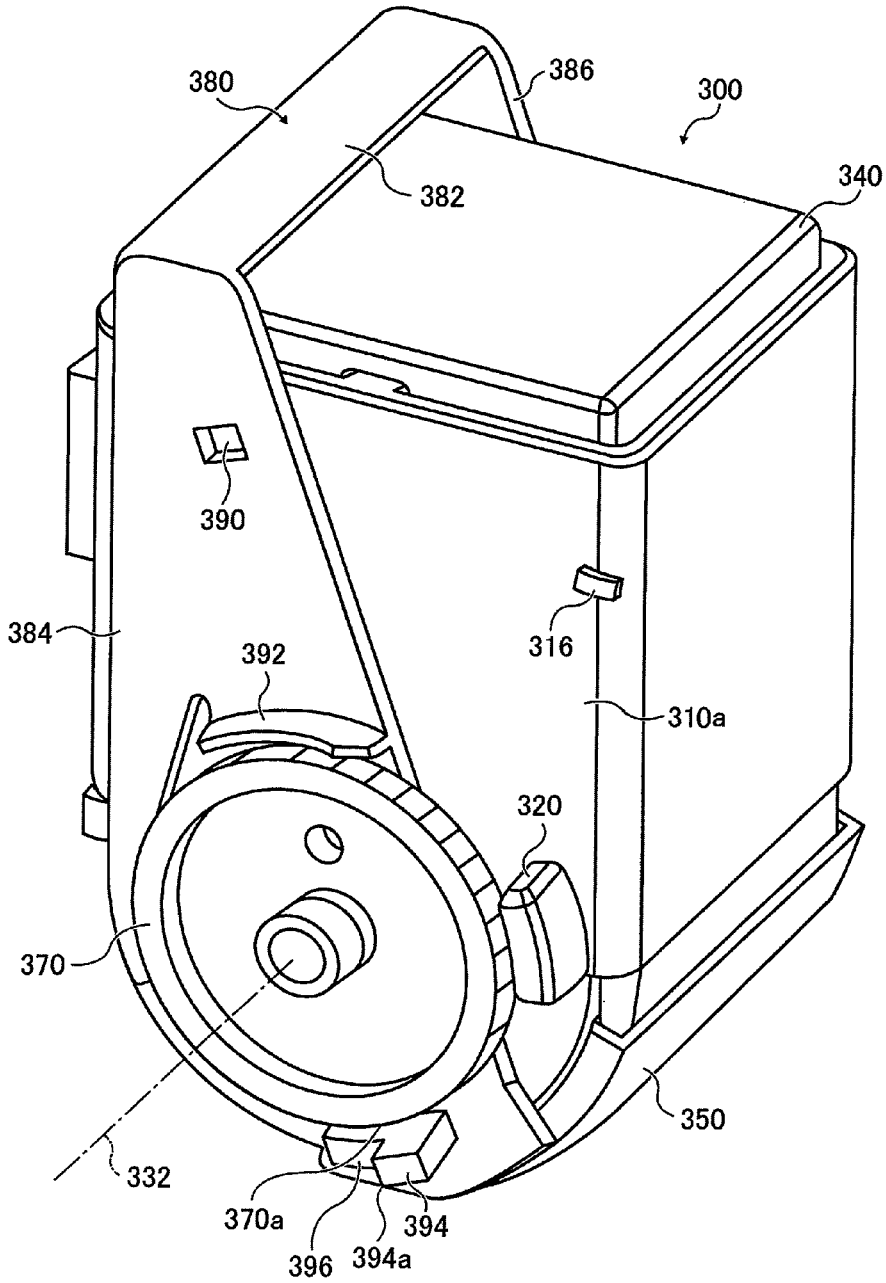
FIG. 3 is a first perspective view showing a storage container according to the exemplary embodiment of the invention.
Figure 4:
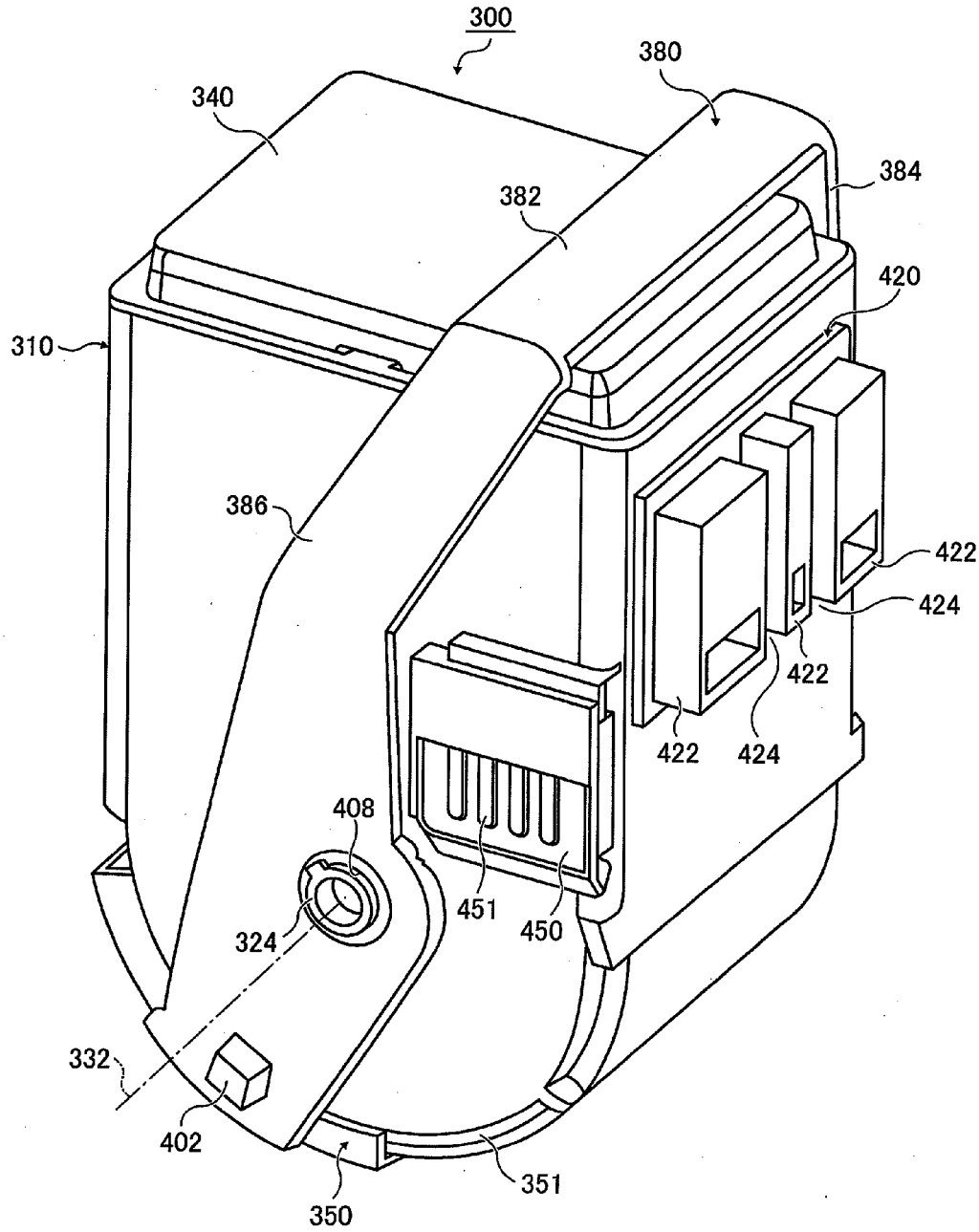
FIG. 4 is a second perspective view showing the storage container according to the exemplary embodiment of the invention.

The guiding projection 394 is located anterior to the gear 370 in a direction in which the container body 310 is mounted to the image forming apparatus body 20. That is, as shown in FIG. 3, a lower end 394*a* of the guiding projection 394 is located below the lower end portion 370*a* of the gear 370, that is, is anterior to the lower end portion 370*a* of the gear 370 in the direction of gravity that is the direction in which the container body 310 is mounted to the image forming apparatus body 20.

Also, the guiding projection 394 is provided on a side face of the container body 310, i.e., a front face 310*a* that is a face on which the gear 370 is mounted, so as to project. Here, the guide projection 394 may be provided on the front face 310*a* so as to project therefrom. For example, the guiding projection 394 may be provided on the front arm portion 384 of the operating member 380 like this exemplary embodiment, and a guide projection may be provided so as to project directly from the front face 310*a* of the container body 310.

Figure 6:
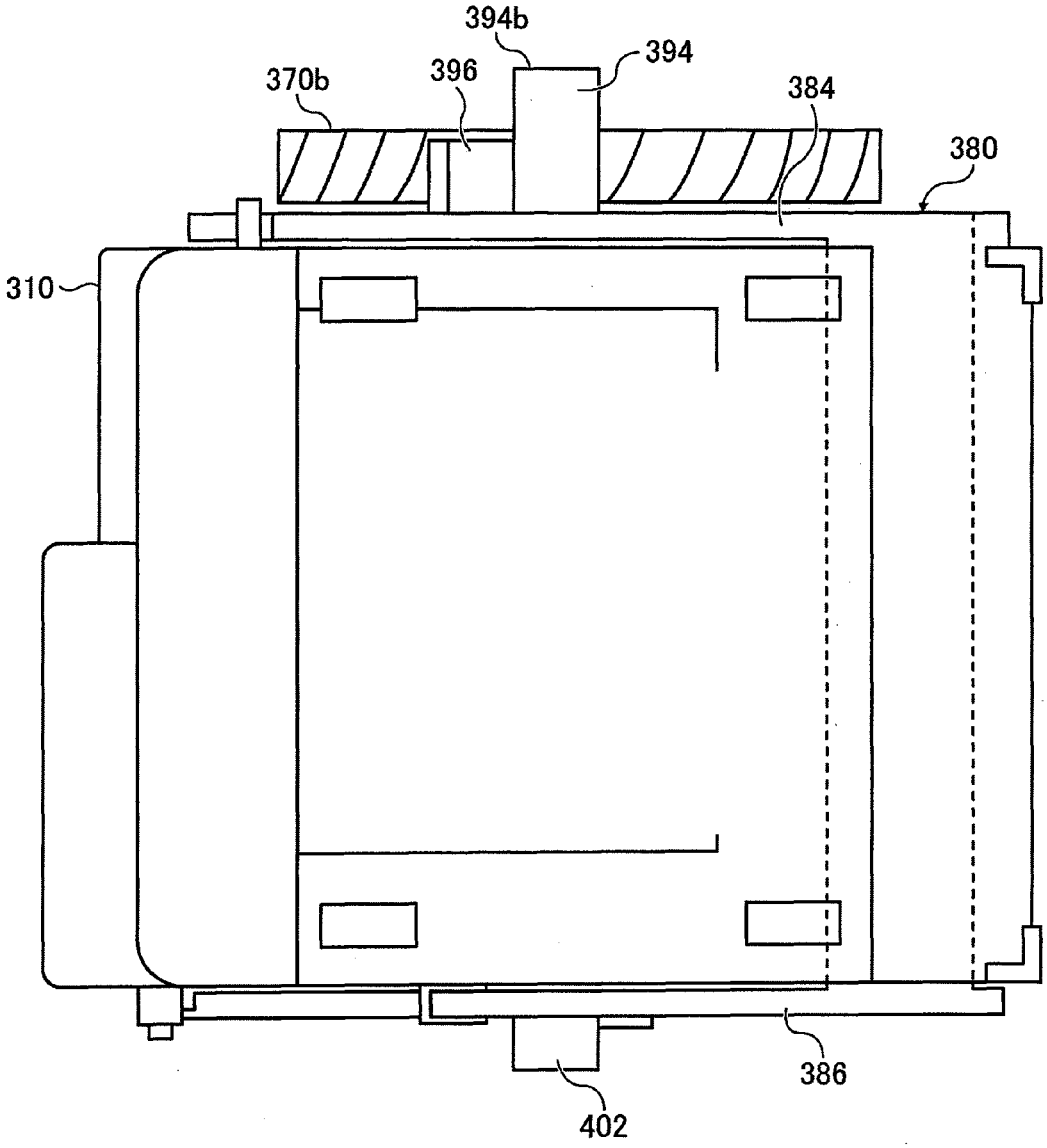
FIG. 6 is a bottom side view showing the storage container according to the exemplary embodiment of the invention.

Also, the guiding projection 394 projects in a direction so as to be farther away from the front face 310*a* than the gear 370 in a direction intersecting the direction in which the container body 310 is mounted to the image forming apparatus body 20. That is, as shown in FIG. 6, a distal end 394*b* of the guiding projection 394 is arranged in a position which is farther away from the front face 310*a* of the container body 310 than a face 370*b* of the gear 370 opposite to the container body 310.

Also, a collision suppressing projection 396 is formed with continuing to the guiding projection 394, at the lower end of the front arm portion 384 and on the distal end in the direction in which the storage container 300 is inserted into the image forming apparatus body 20. The collision suppressing projection 396 also makes it difficult for the face of the gear 370 on which the teeth are formed to collide with the image forming apparatus body 20 when the storage container 300 is being inserted into the image forming apparatus body 20. The guiding projection 394 and the collision suppressing projection 396 are formed in an arc shape so as to cover the lower portion of the gear 370 including at least the lowermost point thereof.

By arranging the guiding projection 394 and the collision suppressing projection 396 in the positions described above, the guiding projection 394 and the collision suppressing projection 396 realize a function of making it difficult for, for example, the face of the gear 370 on which the teeth are formed to collide with the image forming apparatus body 20 when the storage container 300 is being mounted to the image forming apparatus body 20. That is, when the storage container 300 is being mounted to the image forming apparatus body 20, the guiding projection 394 or the collision suppressing projection 396 anterior to the gear 370 in the mounting direction first collides with the image forming apparatus body 20, which makes it difficult for the gear 370 to collide with the image forming apparatus body 20.

Also, the guiding projection 394 is arranged on the front end side in the direction in which the container body 310 is mounted to the image forming apparatus body 20, i.e., in this exemplary embodiment, on the lower side in the direction of gravity. For this reason, when the container body 310 is being mounted to the image forming apparatus body 20, the operation of inserting the guiding projection 394 into the guide groove 46 is facilitated.

A guiding projection 402 is formed on the lower end side of the rear arm portion 386 similarly to the fact that the guiding projection 394 is formed on the front arm portion 384. The guiding projection 402 is fitted into a guide groove 44 (see FIG. 11) formed on the image forming apparatus body 20, and guides attachment and detachment of the storage container 300 into and from the image forming apparatus body 20.

The operating member 380 and the opening and closing member 352 are connected with each other. That is, a portion of the front arm portion 384 on the lower end side thereof is connected with the front portion of the opening and closing member 352, and a portion of the rear arm portion 386 on the lower end thereof is connected with the rear portion of the opening and closing member 352. Therefore, the operating member 380 moves in conjunction with movement of the opening and closing member 352.

The gear 370 is mounted to the front face of the container body 310, and when the storage container 300 is mounted to the image forming apparatus body 20, the gear 370 is connected with a gear (not shown) provided on the image forming apparatus body 20 so as to receive a driving transmission force from this gear. At this time, the position, where the gear 370 and the gear (not shown) provided on the image forming apparatus body 20 are connected with each other, is between the guiding projection 394 and the protecting projection 320. The guiding projection 394 is located substantially at the lowest point of the gear 370, and an opposite side of the guiding projection 394 to the collision suppressing projection 396 does not extend so that its arc covers the lower portion of the gear 370 unlike the collision suppressing projection 396. This is because the gear (not shown) and the guiding projection 394, which are provided on the image forming apparatus body 20, don not interfere with each other in a state as shown in FIG. 8A, i.e., in a state where the storage container 300 is mounted to the image forming apparatus body 20. Also, the gear 370 is connected with a portion of the shaft 322, which projects out of the container body 310. Therefore, when a driving force is transmitted so as to rotate the gear 370, the stirring device 330 is rotated within the container body 310, and the toner stored within the container body 310 is stirred.

The storage container 300 has the lid member 340, which is used as a sealing part for sealing the filling hole 314, as well as the container body 310, the opening and closing part 350, the operating member 380, and the gear 370. The lid member 340 is mounted to the container body 310 so as to fit into the filling hole 314 after the toner is filled into the container body 310 via the filling hole 314. When the lid member 340 is mounted, the filling hole 314 is sealed, and the toner is prevented from spilling out from the filling hole 314 irrespective of the direction of the container body 310.

FIGS. 8A to 8C and 9A to 9C explain an operation of the operating member 380.

Figure 8C:
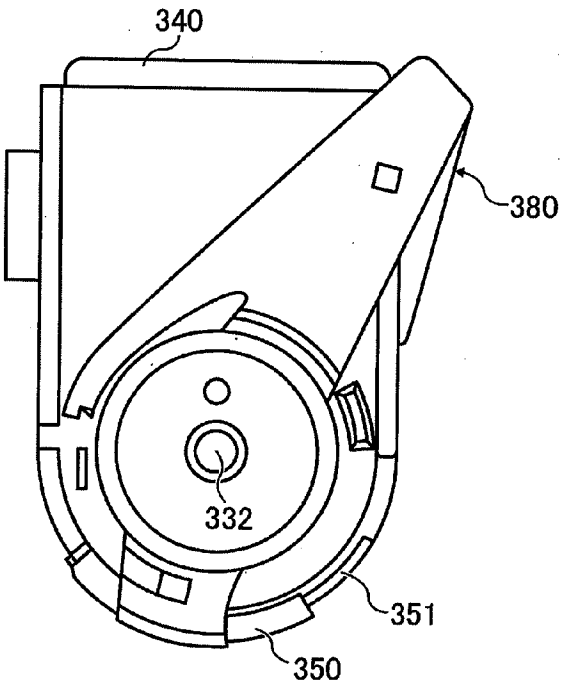
Figure 9C:
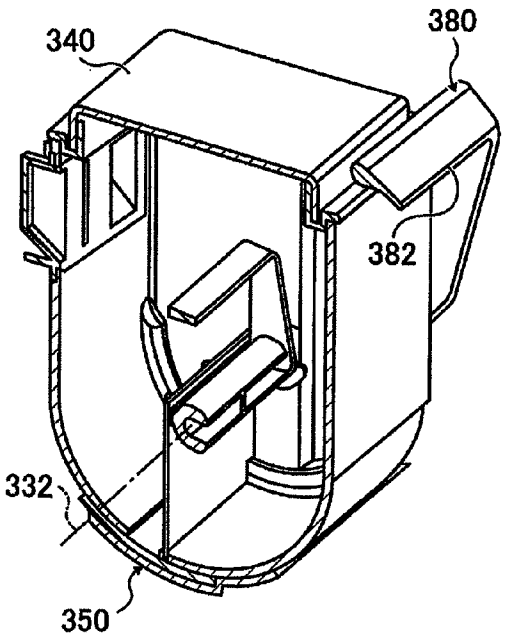
FIGS. 9A to 9C illustrate the movement of the operating member of the storage container according to the exemplary embodiment of the invention, and specifically.
Figure 9B:
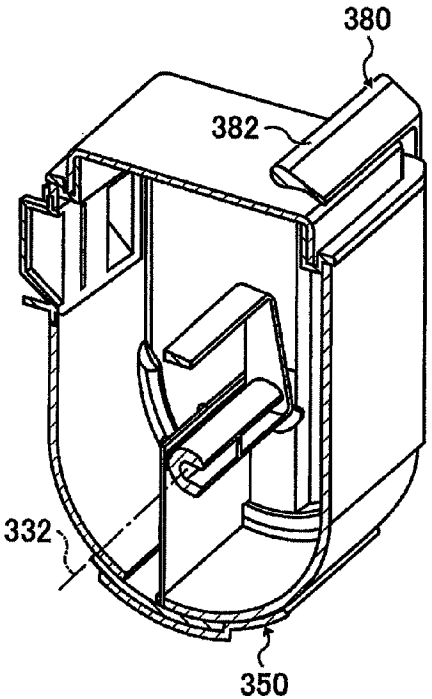
Figure 9A:
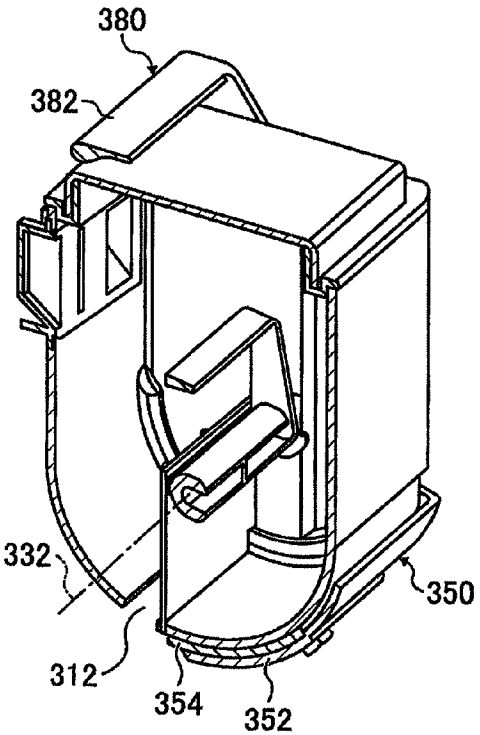

The operating member 380 can be moved between the first position shown in FIGS. 8A and 9A, the second position shown in FIGS. 8B and 9B, and the third position shown in FIGS. 8C and 9C.

The first position shown in FIGS. 8A and 9A is a position where the discharge hole 312 formed in the container body 310 is brought into the opened state. That is, when the operating member 380 is located in the first position, the opening and closing part 350 connected with the operating member 380 is brought into a state of being arranged in a position apart from the discharge hole 312. When the storage container 300 is mounted to the image forming apparatus body 20 so as to supply the toner to the developing device 110, the operating member 380 is operated so as to be brought into the state of being arranged in the first position.

The second position shown in FIGS. 8B and 9B is a state where the discharge hole 312 is closed and the facing portion 382 of the operating member 380 is arranged in a position where the facing portion 382 overlaps the filling hole 314 in the direction (vertical direction in this exemplary embodiment) along which the storage container 300 is filled with toner. When the operating member 380 is located in the second position, the opening and closing part 350 connected with the operating member 380 is brought into a state of being arranged in the position where the opening and closing part covers the discharge hole 312 and the discharge hole 312 is brought into a state of being blocked.

The third position shown in FIGS. 8C and 9C is a state where the discharge hole 312 is closed and the facing portion 382 of the operating member 380 is arranged in a position where the facing portion 382 does not overlap the filling hole 314 in the direction (vertical direction in this exemplary embodiment) along which the storage container 300 is filled with toner. When the operating member 380 is located in the third position, the opening and closing part 350 connected with the operating member 380 is brought into a state of being arranged in the position where the opening and closing part covers the discharge hole 312 and the discharge hole 312 is brought into a state of being blocked. Since the operating member 380 and the opening and closing part 350 are connected together, when the operating member 380 is moved to the third position from the second position, the opening and closing part 350 also moves in conjunction with the movement of the operating member 380. However, since the size of the opening and closing part 350 is formed to be larger than that of the discharge hole 312, the opening and closing part 350 moves with the discharge hold 312 being blocked, i.e., in a state where the sealing member 354 of the opening and closing part 350 seals the discharge hole 312. Also, when the operating member 380 is located in the third position, the facing portion 382 is brought into the state where the facing portion 382 does not overlap the filling hole 314 in the vertical direction that is the direction along which the container body 310 is filled with toner.

In addition, in order for the opening and closing part 350 to move with respect to the container body 310, the container body 310 is provided with an opening and closing part guide groove 351 which serves as a guide part which guides the opening and closing part 350. The opening and closing part guide groove 351 is provided so as to extend in both the opening and closing directions of the opening and closing part 350, i.e., not only in the opening direction of the opening and closing part 350 but also in the closing direction of the opening and closing part 350, when the opening and closing part 350 is located in the second position. When the opening and closing part 350 is moved between the second position and the third position, the opening and closing part 350 is guided by the opening and closing part guide groove 351 while being kept in a state where the sealing member 354 of the opening and closing part 350 seals the discharge hole 312.

When it is attempted to mount the storage container 300 to the image forming apparatus body 20 in a state where the operating member 380 is located at the third position, the operating member 380 and the image forming apparatus body 20 interfere with each other. That is, the operating member 380 is used as an interference part which interferes with the image forming apparatus body 20 when the storage container 300 is mounted to the image forming apparatus body 20 in the state where the operating member 380 is located in the third position.

When the operating member 380 is located in the third position and toner is filled into the container body 310, the facing portion 382 hardly hinders movement (falling) of the toner. After the operating member 380 is arranged in the third position and toner is filled into the container body 310, the filling hole 314 of the container body 310 is closed by the lid member 340.

Figure 10:
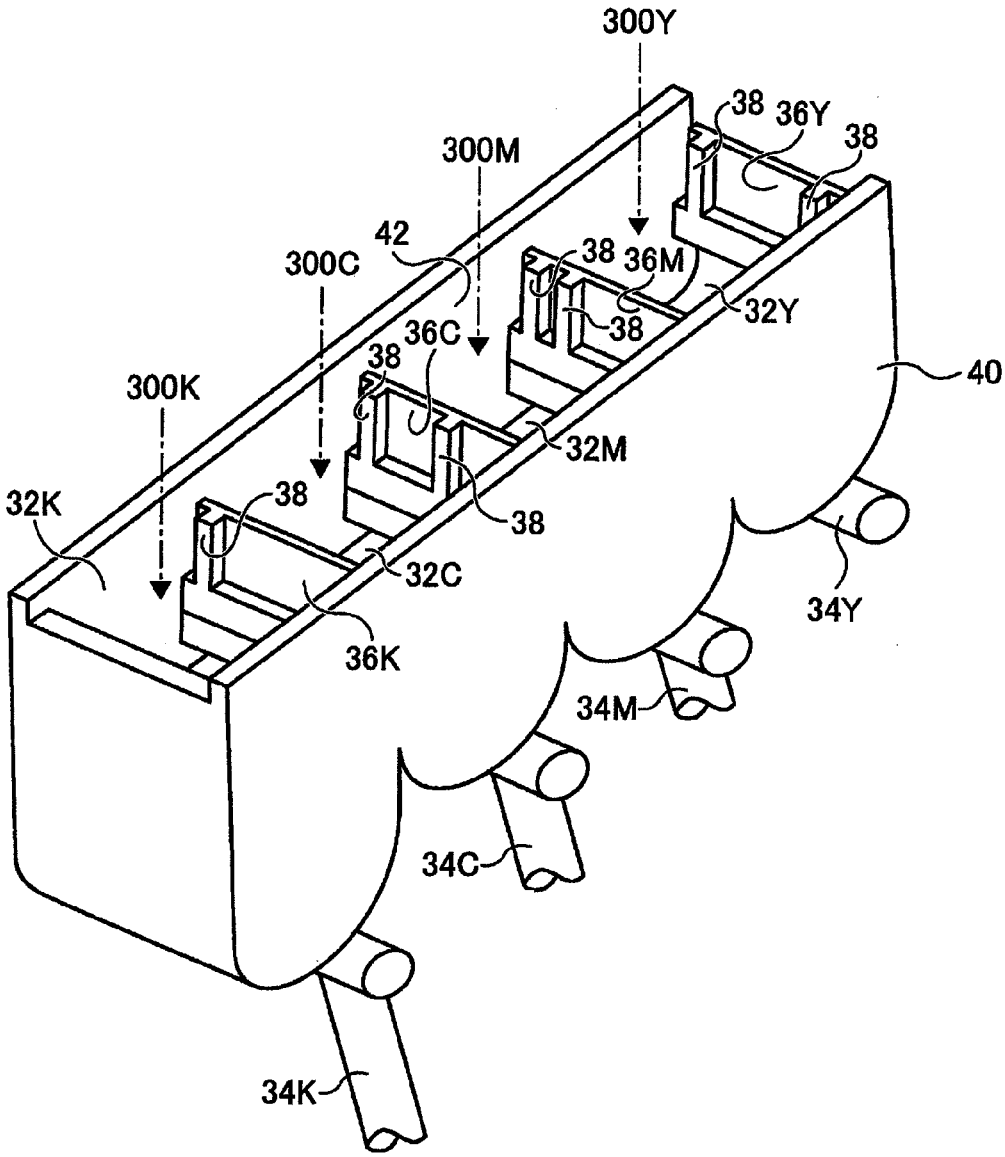
FIG. 10 is a first perspective view showing a mounting part which is formed in an apparatus body of the image forming apparatus according to the exemplary embodiment of the invention and which is mounted with the storage container.

FIG. 10 is a perspective view of the mounting device 30.

The mounting device 30 has a front side plate 40, a rear side plate 42, and connecting plates 36Y, 36M, 36C, and 36K which connects the front side plate 40 with the rear side plate 42, and mounting chambers 32Y, 32M, 32C, and 32K whose tops are opened and which are respectively formed by these members. The storage containers 300Y, 300M, 300C, and 300K are respectively mounted to the mounting chambers 32Y, 32M, 32C, and 32K from above.

Toner conveyance passages 34Y, 34M, 34C, and 34K are attached to lower portions of the mounting chambers 32Y, 32M, 32C, and 32K. The toner conveyance passages 34Y, 34M, 34C, and 34K are used to convey the toner in the storage containers 300Y, 300M, and 300C, and 300K to the developing devices 110Y, 110M, 110C, and 110K, respectively.

Since each of the connecting plates 36Y, 36M, 36C, and 36K is used as a body-side identification member, one or plural single convex portions 38 are formed in each connecting plate 36 so that the connecting plates 36Y, 36M, 36C, and 36K are different from each other in at least any one of the number, position, and width.

A convex portion(s) 38 are formed to have such sizes and positions that the convex portion(s) 38 can be fitted into the concave portion(s) 424 (see FIG. 4) provided in the storage container 300 to be mounted to each mounting chamber 32. For example, the convex portions 38 are formed on the mounting chamber 32Y so as to fit into the concave portions 424 formed in the yellow storage container 300Y which is to be mounted to the mounting chamber 32Y. As mentioned above, the positions of the concave portions 424 formed in the storage container 300 differ depending on, for example, the type of the toner stored in the storage container 300, such as the color of the toner. Therefore, the correct storage container 300 to be mounted to a specific mounting chamber 32 can be mounted to the mounting chamber 32. However, even if an attempt is made to mount a storage container 300 which is not the storage container 300 to be housed in the mounting chamber 32 and in which a different type of toner is stored, the convex portions 422 of the storage container 300 and the convex portions 38 of the identification member 420 interfere with each other, so that the storage container 300 cannot be mounted to the mounting chamber 32.

Figure 11:
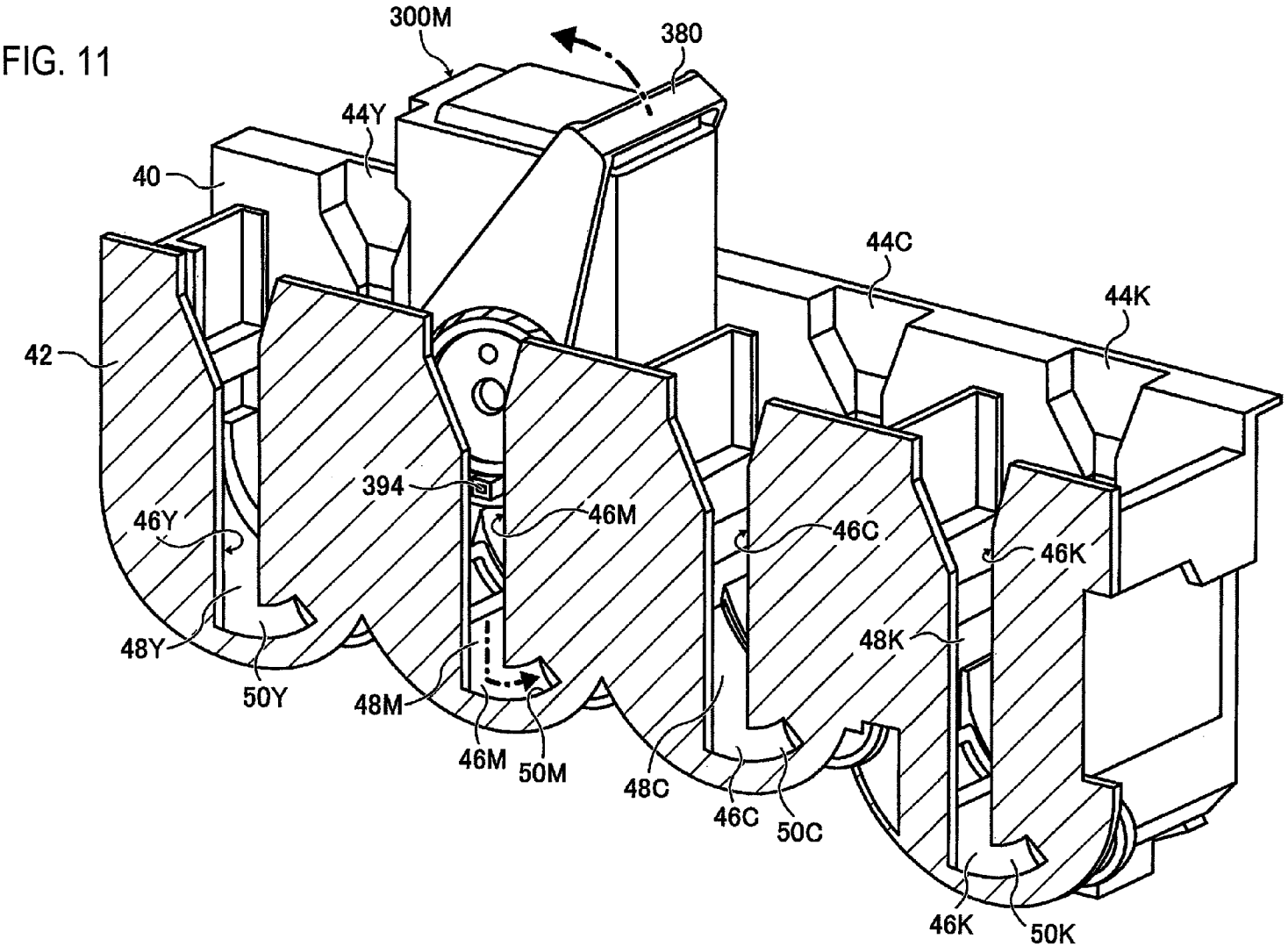
FIG. 11 is a second perspective view showing the mounting part which is formed in the apparatus body of the image forming apparatus according to the exemplary embodiment of the invention and which is mounted with the storage container.

FIG. 11 is a section view of the mounting device 30.

As shown in FIG. 11, four guide grooves 44Y, 44M, 44C, and 44K are formed in the front side plate 40 of the mounting device 30. The guiding projections 402 (see FIG. 4) are respectively fitted into the guide grooves 44Y, 44M, 44C, and 44K, and guide mounting of the storage containers 300Y, 300M, 300C, and 300K, when the storage containers 300Y, and 300M, 300C and 300K are respectively mounted to the mounting chambers 32Y, 32M, 32C, and 32K.

Four guide grooves 46Y, 46M, 46C, and 46K are formed in the rear side plate 42. The guiding projections 394 (see FIG. 3) are fitted into each of the guide grooves 46Y, 46M, 46C, and 46K, and guide the mounting of each of the storage containers 300Y, 300M, 300C, and 300K to the mounting chambers 32, when the storage containers 300Y, and 300M, 300C and 300K are respectively mounted to the mounting chambers 32Y, 32M, 32C, and 32K. Each guide groove 46 has a mounting direction guide portion 48 which has a wide entrance side, gets narrower gradually in the mounting direction of the storage container 300, and then has the same width, and a circular-arc portion 50 which extends in a substantially circular-arc shape from an end of the mounting direction guide portion 48 at a deep side thereof. When the operating member 380 is operated so as to move to the first position after the storage container 300 is mounted to the mounting chamber 32, the guiding projection 402 enters the circular-arc portion 50.

Each circular-arc portion 50 is used as a prohibition member which prohibits the storage container 300 from removed from the image forming apparatus body 20 in a state where the operating member 380 is arranged in the first position. That is, even if the guiding projection 394 enters the circular-arc portion 50, and the storage container 300 is lifted up so as to remove the storage container 300 in the state where the operating member 380 is arranged in the first position, the guiding projection 394 interferes with a portion of the rear side plate 42 which constitutes the circular-arc portion 50 so that the storage container 300 cannot be removed from the image forming apparatus body 20.

Figure 12B:
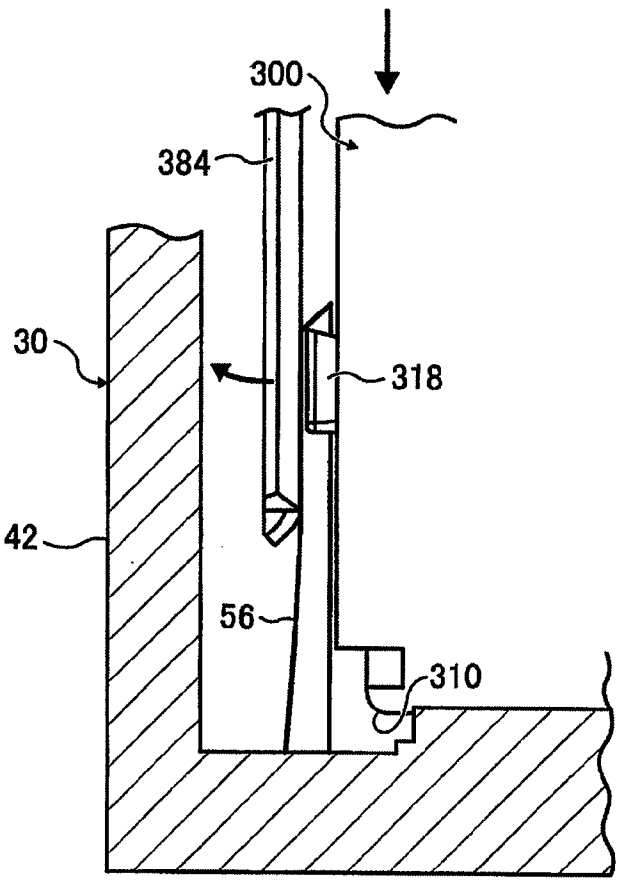
FIGS. 12A and 12B illustrate that the storage container according to the exemplary embodiment of the invention is being mounted to a mounting device.
Figure 12A:
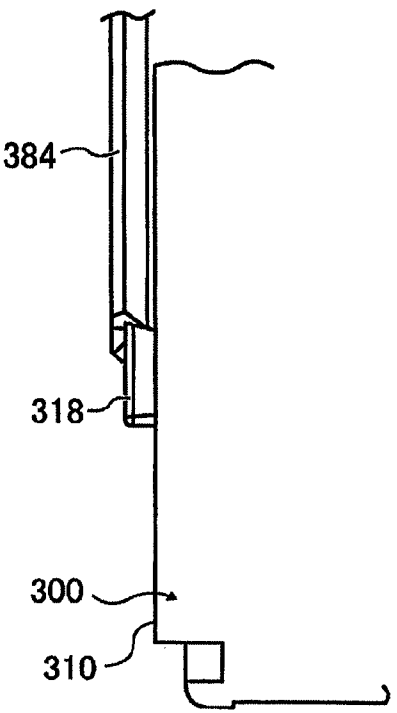

FIGS. 12A and 12B illustrate that the storage container 300 is mounted to the mounting device 30, FIG. 12A is a right side view of the storage container 300 in a state where the operating member 380 is arranged in the second position, and FIG. 12B is a view showing the right side face of the storage container 300 and a cross-section of the mounting device 30.

As shown in FIG. 12A, when the storage container 300 is not mounted on the image forming apparatus body 20, the prohibiting projection 318 (also see FIG. 5) is located in a position where the projection 318 interferes with a locus of movement of the front arm portion 384 of the operating member 380 in a state where the operating member 380 is arranged in the second position, so that the operating member 380 cannot be moved to the first position from the second position.

On the other hand, when the storage container 300 is inserted into the image forming apparatus body 20, as shown in FIG. 12B, an insertion member 56, which is provided so as to project upward from a bottom face of the mounting device 30, is inserted between the container body 310 and the front arm portion 384, and the front arm portion 384 deforms in a direction away from the container body 310 and moves to a position where the front arm portion 384 does not interfere with the prohibiting projection 318. Therefore, if the storage container 300 is mounted to the image forming apparatus body 20, the operating member 380 can be moved from the second position to the first position.

Figure 13:
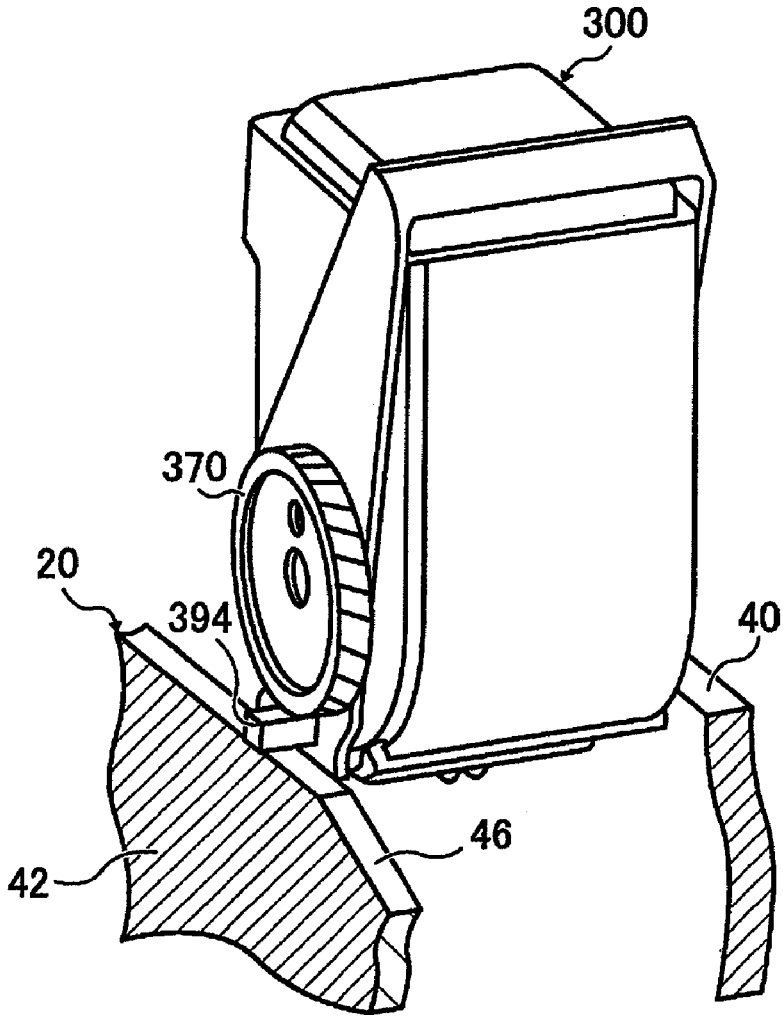
FIG. 13 is a perspective view showing a state where the storage container according to the exemplary embodiment of the invention is being mounted to the image forming apparatus body.

A state where the storage container 300 according to the embodiment of the invention is being mounted to the image forming apparatus body 20 is shown in FIG. 13.

Although the storage container 300 should be mounted to the image forming apparatus body 20 so that the guiding projection 394 is fitted into the portion in which the guide groove 46 formed in the rear side plate 42 is formed, for example, as shown in FIG. 13, it is assumed that the storage container 300 is mounted so that the guiding projection 394 comes to a portion in which the guide groove 46 is not formed. In this case, although the guiding projection 394 collides with the rear side plate 42, the gear 370 does not collide with the rear side plate 42. Therefore, any damage on the gear 370 is hardly caused by an erroneous operation when the storage container 300 is mounted to the image forming apparatus body 20.

Figure 14:
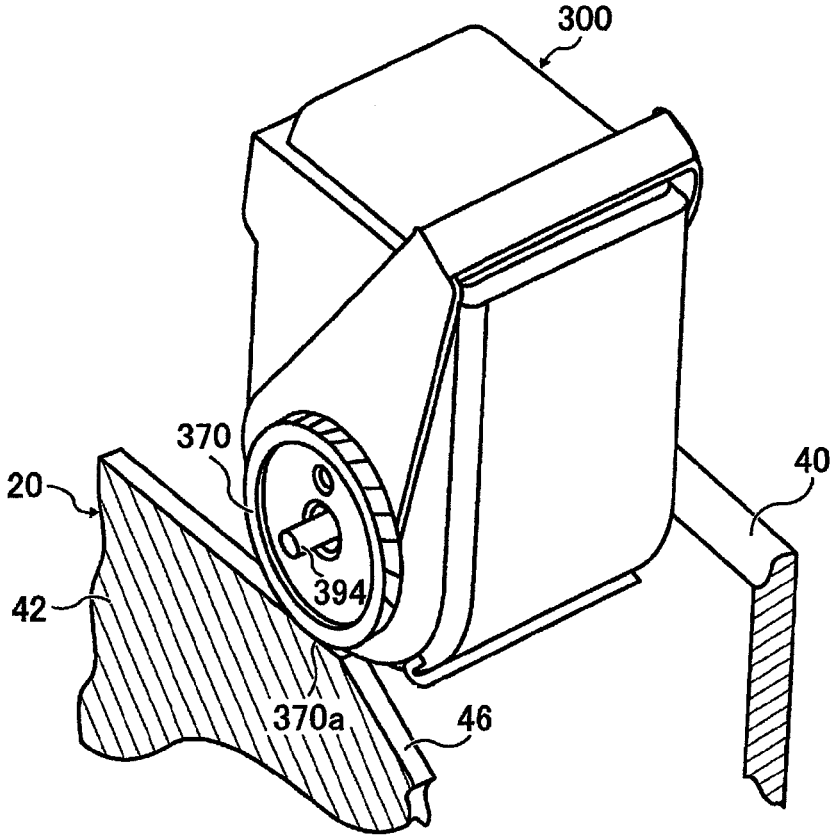
FIG. 14 is a perspective view showing a state where a storage container according to a comparative example is being mounted to the image forming apparatus body.

FIG. 14 shows a state where the storage container 300 according to a comparative example of the invention is being mounted to the image forming apparatus body 20. In the storage container 300 according to this comparative example, the guiding projection 394 is arranged above the lower end portion 370*a* of the gear 370. Although the storage container 300 according to this comparative example should be mounted to the image forming apparatus body 20 so that the guiding projection 394 is fitted into the portion in which the guide groove 46 formed in the rear side plate 42 is formed, for example, as shown in FIG. 14, it is assumed that an attempt to mount the storage container 300 is made so that the guiding projection 394 comes to a portion in which the guide groove 46 is not formed. In this case, for example, the portion of the gear 370 on which the teeth are formed is apt to collide with the rear side plate 42, and the gear 370 is apt to be damaged.

In the exemplary embodiment described above, a form in which the container is filled with the toner made of powder serving as an example of an image forming agent has been described. However, the invention is applicable to the case where a container is filled with, for example, ink in liquid form or the like.

Also, in the exemplary embodiments described above, the case has been described where a printer is used as an example of an image forming apparatus. However, the image forming apparatus of the invention includes other single-function apparatuses which performs a process using an image forming agent, such as a copying machine and a facsimile, or other apparatuses which have plural functions, such as a printer and a scanner, and which perform a process using an image forming agent. The invention is also applicable to these image forming apparatuses. Also, the image forming apparatus of the invention also includes apparatuses, such as visual equipment, such as a television, a DVD player, and an HDD, into which components which form an image using an image forming agent are incorporated, and the invention can be applied to these image forming apparatuses. Also, the image forming apparatus of the invention also includes apparatuses which are incorporated into, for example, a desk, a shelf, a wall, etc., and which form an image using an image forming agent, and the invention can be applied to these image forming apparatuses.

As described above, the invention is applicable to an image forming agent storage container, an image forming apparatus, a method of mounting the image forming agent storage container, and a method of removing the image forming agent storage container.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

DESCRIPTION OF REFERENCE NUMERALS AND SIGNS

10: IMAGE FORMING APPARATUS
20: IMAGE FORMING APPARATUS BODY
46: GUIDE GROOVE
100: IMAGE FORMING PART
300: STORAGE CONTAINER
310: CONTAINER BODY
**310*a***: FRONT FACE
370: GEAR
394: GUIDING PROJECTION

What is claimed is:

1. An image forming agent storage container comprising:

a container body that stores an image forming agent, the container body configured to be mounted to an image forming apparatus body;

a driven transmission member that is provided along a side face of the container body, wherein a driving force is transmitted to the driven transmission member;

an operating member that is rotatably supported on the container body; and a guide part that is provided on the operating member, wherein the guide part guides mounting of the container body to the image forming apparatus body, the guide part is located in a position anterior to the driven transmission member in a mounting direction in which the container body is mounted to the image forming apparatus body, and the guide part is provided so as to project in a direction away from the side face of the container body.

2. The image forming agent storage container according to claim 1, wherein the guide part is disposed at a front end of the container body in the mounting direction.

3. The image forming agent storage container according to claim 1, wherein the guide part projects so as to be further away from the side face than the driven transmission member, in a direction intersecting the mounting direction.

4. The image forming agent storage container according to claim 1, wherein a first protecting projection is located posterior to the driven transmission member in the mounting direction in which the container body is mounted to the image forming apparatus body, and is provided so as to project in the direction away from the side face of the container body.

5. The image forming agent storage container according to claim 4, wherein a second protecting projection is located in a position between the guide part and the first protecting projection along a peripheral edge of the driven transmission member, and is provided so as to project in the direction away from the side face of the container body.

6. The image forming agent storage container according to claim 1, wherein the driven transmission member is provided along the side face of the container body with a side face of the driven transmission member being exposed, after the guide part is provided.

7. The image forming agent storage container according to claim 1, further comprising:

a collision suppressing projection that is formed with continuing to the guide part and suppresses the driven transmission member from colliding with the image forming apparatus body, wherein the container body is configured to be inserted downward into the image forming apparatus body from above, the guide part is disposed at a front end of the container body in the mounting direction, the guide part projects to be further away from the side face than the driven transmission member in a direction intersecting the mounting direction, in the direction intersecting the mounting direction, a projecting-side distal end portion of the collision suppressing projection is closer to the side surface of the container body than a distal end portion of the guide part, and the guide part and the collision suppressing projection are formed in an arc shape so as to cover a lower side of the driven transmission member including a lowermost part of the driven transmission member.

8. The image forming agent storage container according to claim 1, further comprising:

an opening and closing member that is connected with the operating member, wherein the container body is formed with a discharge hole in a lower side thereof, and the opening and closing member is configured to close the discharge hole.

9. The image forming agent storage container according to claim 1, wherein the guide part is configured to prohibit the mounted container body from being removed from the image forming apparatus body during a state where the operating member is arranged in a first position.

10. An image forming apparatus comprising:

an image forming apparatus body;

an image forming agent storage container that stores an image forming agent; and an image forming part that is provided within the image forming apparatus body and that forms an image using the image forming agent stored in the image forming agent storage container, wherein the image forming agent storage container includes a container body that stores the image forming agent, the container body configured to be mounted to the image forming apparatus body, a driven transmission member that is provided along a side face of the container body, a driving force being transmitted to the driven transmission member, an operating member that is rotatably supported on the container body; and a guide part that is provided on the operating member, wherein the guide part guides mounting of the container body to the image forming apparatus body, the guide part is located in a position anterior to the driven transmission member in a mounting direction in which the container body is mounted to the image forming apparatus body, and the guide part is provided so as to project in a direction away from the side face of the container body.

11. The image forming apparatus according to claim 10, wherein the image forming agent storage container further includes a collision suppressing projection that is formed with continuing to the guide part and that suppresses the driven transmission member from colliding with the image forming apparatus body, the container body is configured to be inserted downward into the image forming apparatus body from above, the guide part is disposed at a front end of the container body in the mounting direction, the guide part projects to be further away from the side face than the driven transmission member in a direction intersecting the mounting direction, in the direction intersecting the mounting direction, a projecting-side distal end portion of the collision suppressing projection is closer to the side surface of the container body than a distal end portion of the guide part, and the guide part and the collision suppressing projection are formed in an arc shape so as to cover a lower side of the driven transmission member including a lowermost part of the driven transmission member.

12. A method of mounting an image forming agent storage container, the method comprising:

guiding the image forming agent storage container by a guide part of the image forming agent storage container so as to mount the image forming agent storage container to an image forming apparatus body, wherein the image forming agent storage container includes a container body that stores an image forming agent, the container body configured to be mounted to an image forming apparatus body, a driven transmission member that is provided along a side face of the container body, a driving force being transmitted to the driven transmission member, an operating member that is rotatably supported on the container body; and wherein the guide part is provided on the operating member, the guide part guides the mounting of the container body to the image forming apparatus body, the guide part is located in a position anterior to the driven transmission member in a mounting direction in which the container body is mounted to the image forming apparatus body, and the guide part is provided so as to project in a direction away from the side face of the container body.

13. The method according to claim 12, wherein the image forming agent storage container further includes a collision suppressing projection that is formed with continuing to the guide part and that suppresses the driven transmission member from colliding with the image forming apparatus body, the container body is configured to be inserted downward into the image forming apparatus body from above, the guide part is disposed at a front end of the container body in the mounting direction, the guide part projects to be further away from the side face than the driven transmission member in a direction intersecting the mounting direction, in the direction intersecting the mounting direction, a projecting-side distal end portion of the collision suppressing projection is closer to the side surface of the container body than a distal end portion of the guide part, and the guide part and the collision suppressing projection are formed in an arc shape so as to cover a lower side of the driven transmission member including a lowermost part of the driven transmission member.

14. A method of removing an image forming agent storage container, the method comprising:

guiding the image forming agent storage container by a guide part of the image forming agent storage container so as to remove the image forming agent storage container from an image forming apparatus body, wherein the image forming agent storage container includes a container body that stores an image forming agent, the container body configured to be mounted to an image forming apparatus body, a driven transmission member that is provided along a side face of the container body, wherein a driving force is transmitted to the driven transmission member, an operating member that is rotatably supported on the container body; and wherein the guide part is provided on the operating member, the guide part guides the mounting of the container body to the image forming apparatus body, the guide part is located in a position anterior to the driven transmission member in a mounting direction in which the container body is mounted to the image forming apparatus body, and the guide part is provided so as to project in a direction away from the side face of the container body.

15. The method according to claim 14, wherein the image forming agent storage container further includes a collision suppressing projection that is formed with continuing to the guide part and that suppresses the driven transmission member from colliding with the image forming apparatus body, the container body is configured to be inserted downward into the image forming apparatus body from above, the guide part is disposed at a front end of the container body in the mounting direction, the guide part projects to be further away from the side face than the driven transmission member in a direction intersecting the mounting direction, in the direction intersecting the mounting direction, a projecting-side distal end portion of the collision suppressing projection is closer to the side surface of the container body than a distal end portion of the guide part, and the guide part and the collision suppressing projection are formed in an arc shape so as to cover a lower side of the driven transmission member including a lowermost part of the driven transmission member.

* * * * *